United States Patent [19]

Thompson

[11] 4,066,185

[45] Jan. 3, 1978

[54] SPLICING TAPE ASSEMBLY AND DISPENSER THEREFOR

[76] Inventor: Wilmer B. Thompson, Rte. 1, Social Circle, Ga. 30279

[21] Appl. No.: 668,854

[22] Filed: Mar. 22, 1976

[51] Int. Cl.[2] ..... B65H 3/58

[52] U.S. Cl. ..... 221/26; 225/106

[58] Field of Search ..... 221/25, 26, 70–74; 428/42; 156/248, 541, 542, 584; 225/106

[56] References Cited

U.S. PATENT DOCUMENTS

| | | | |
|---|---|---|---|
| 2,079,005 | 5/1937 | Freydberg | 221/70 |
| 2,765,205 | 10/1956 | Capella et al. | 221/73 X |
| 3,389,832 | 6/1968 | Smith et al. | 221/70 |

FOREIGN PATENT DOCUMENTS

| | | | |
|---|---|---|---|
| 637,036 | 5/1950 | United Kingdom | 428/42 |

*Primary Examiner*—Robert B. Reeves
*Assistant Examiner*—Joseph J. Rolla
*Attorney, Agent, or Firm*—Jones, Thomas & Askew

[57] ABSTRACT

The splicing tape assembly includes a continuous carrier member having a plurality of splicing tape strips releasably adhered thereto, and a plurality of tabs releasably adhered to the splicing strips. The dispenser includes a core for supporting a roll of material constituting the splicing tape assembly, and a clamp assembly for engaging the carrier member and holding the splicing tape assembly conveniently for removal of splicing tape strips as desired.

9 Claims, 6 Drawing Figures

SPLICING TAPE ASSEMBLY AND DISPENSER THEREFOR

This invention relates to tape splicing strips and the like, and is more particularly concerned with a splicing tape assembly, and a dispenser which supports the tape assembly for ready removal of the strips.

It is frequently desirable, or necessary, to provide a small strip of tape to be applied to a piece of magnetic tape primarily for splicing the magnetic tape. Additionally, such strips of tape have been utilized in conjunction with a magnetic tape as a sensing means, the splicing strip being electrically conductive so that the presence of a splicing strip can be used to operate appropriate equipment.

In the past, the most frequent means for providing the strips of splicing tape has been simply to provide a large roll of pressure-sensitive tape, with the roll being appropriately cut by appropriate means for providing the strips required. The cut strips were then attached to the magnetic tape. As an improvement over the prior method of providing splicing tapes, U.S. Pat. No. 3,663,343 discloses means for providing strips of splicing, or sensing, tape wherein a continuous strip of splicing or sensing tape is applied to a release sheet, and the release sheet is, in turn, fixed to a carrier strip. The splicing tape and release sheet are appropriately cut to provide a plurality of strips of splicing tape, each of the strips being attached to a continuous piece of release paper and to a tab comprising a portion of the release paper. The arrangement is such that a single tab can be pulled, and the splicing strip will release from the continuous strip of release paper so that the tab provides a convenient applicator for the first section of the splicing tape. The tab can then be removed from the splicing tape and the splice can be completed.

While the above-described prior art splicing tape arrangement represented an improvement in its time, it requires the release paper to be attached to the carrier throughout the length of the release paper. Without the carrier strip, the release paper and its plurality of splicing strips would be very difficult to handle and would tend to come to pieces before one intentionally removed the splicing strips. The carrier strip provides no other function in the aforementioned patent, and is discarded along with the release paper when the splicing strips are removed.

The present invention overcomes the above mentioned and other difficulties with the prior art by providing a splicing tape assembly including a continuous carrier member having a plurality of splicing strips releasably adhered thereto, and a plurality of tabs releasably adhered to the splicing strips. The splicing strips and the tabs are formed by cuts made in a continuous strip of pressure-sensitive tape which is directly adhered to a carrier strip. The dispenser includes means for supporting a roll of material constituting the splicing tape assembly, a clamp assembly for engaging the carrier member and holding the splicing tape assembly conveniently for removal of splicing strips as desired, and guide means for guiding the material from the roll of material to the clamp assembly. The clamp assembly is easily and conveniently releasable to facilitate replenishing of the supply of splicing strips by withdrawing more from the roll. The splicing tape assembly is simple, convenient, and relatively inexpensive to manufacture.

These and other features and advantages of the present invention will become apparent from consideration of the following specification when taken in conjunction with the accompanying drawings in which.

Figure 1:
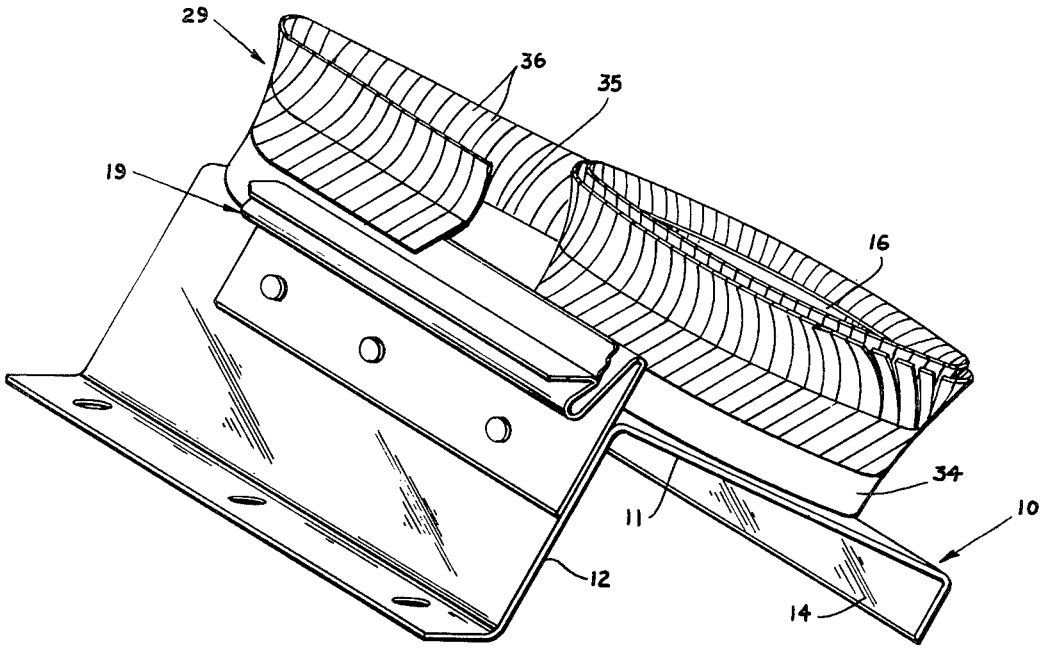
FIG. 1 is a pictorial view showing a dispenser made in accordance with the present invention and supporting a roll of splicing tape assembly which embodies the present invention.

Referring now more particularly to the drawings and to that embodiment of the invention here chosen by way of illustration, it will be seen that the dispenser generally designated at 10 includes a support plate 11 having a depending front flange 12 and rear flange 14. The front flange 12 is here shown as longer than the rear flange 14 in order to dispose the support plate 11 at an angle so that the tabs 36 and their splicing strips 37 are conveniently removable. While the plate 11 and the flanges 12 and 14 can be formed of any convenient material, it is contemplated that the device will be made of sheet plastic material such as a methyl methacrylate, a polystyrene, or other relatively rigid material such as acrylic co-polymers and the like.

Mounted on the plate 11 is a cyclindrical core 16, the core 16 being simply a small cylinder attached, as by welding or gluing, to the plate 11. The core 16 supports and guides a spool containing the splicing tape assembly 29 which will be discussed in more detail hereinafter.

With a spool slipped over the core 16, the splicing tape assembly 29 can then be directed around a guide member 18 which comprises a relatively large radius member cemented or otherwise attached to the plate 11. The guide member 18 is arranged to direct a length of the splicing tape assembly into the clamp assembly generally designated at 19, the clamp assembly 19 having a release flange 20.

Figure 3:
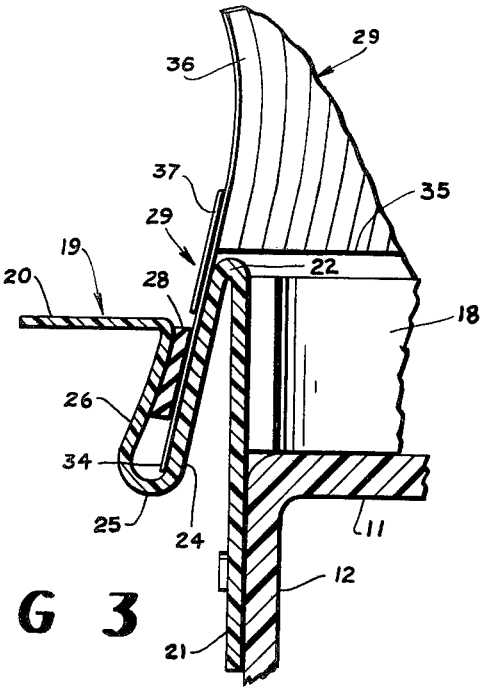
FIG. 3 is an enlarged cross-sectional view taken substantially along the line 3—3 in FIG. 2.
Figure 2:
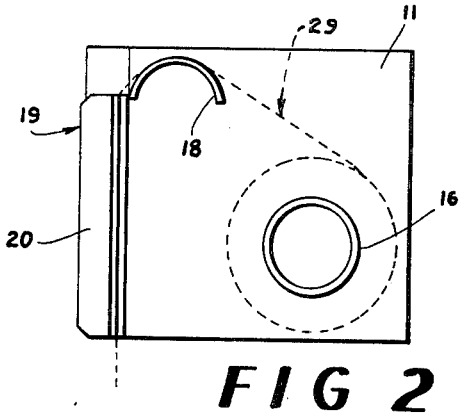
FIG. 2 is a plan view of the support plate of the dispenser shown in FIG. 1.

Looking at FIG. 3 of the drawing for a more detailed showing of the clamp assembly 19, it will be seen that the clamp assembly 19 includes a mounting flange 21 that is secured to the front flange 12 of the dispenser 10. The mounting flange 21 extends upwardly above the plate 11 to terminate in a bend 22 slightly above the upper edge of the guide member 18. A clamp plate 24 extends downwardly from the bend 24 and terminates in a bend 25, the bend 25 being integral with a movable clamp jaw 26. The movable clamp jaw 26 then is connected to the release flange 20. The clamp plate 24 and clamp jaw 26 define a throat therebetween, and between the movable clamp jaw and the clamp plate 24 there is a pressure member 28 for engaging material that is to be held within the clamp assembly 19. It will be seen that the pressure member 28 is here indicated as being formed of rubber, although it will be understood by those skilled in the art that any relatively deformable material can be utilized as the pressure member 28 to provide a clamp jaw sufficiently yieldable to engage material and hold it firmly.

From the foregoing discussion, it should now be understood that a splicing tape assembly can be placed on the core 16 and directed around the guide member 18 and into the clamp assembly 19. The release plate 20 of the clamp assembly 19 can be depressed, which will cause a bending motion at the bend 25 thereby to move the movable clamp jaw 26 away from the clamp plate 24 and cause the pressure member 28 to be released from the clamp plate 24. In this condition, the splicing tape assembly can be moved through the throat and along the clamp assembly 19 as desired, and then the release plate 20 can be released and the clamp assembly 19 will firmly engage the material.

Figure 5:
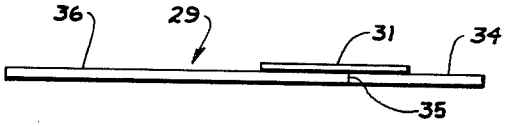
FIG. 5 is an end elevational view of the tape assembly shown in FIG. 4, with the thickness exaggerated for showing detail; and, FIG. 6 is a pictorial view of a single splicing tape and tab according to the present invention.
Figure 4:
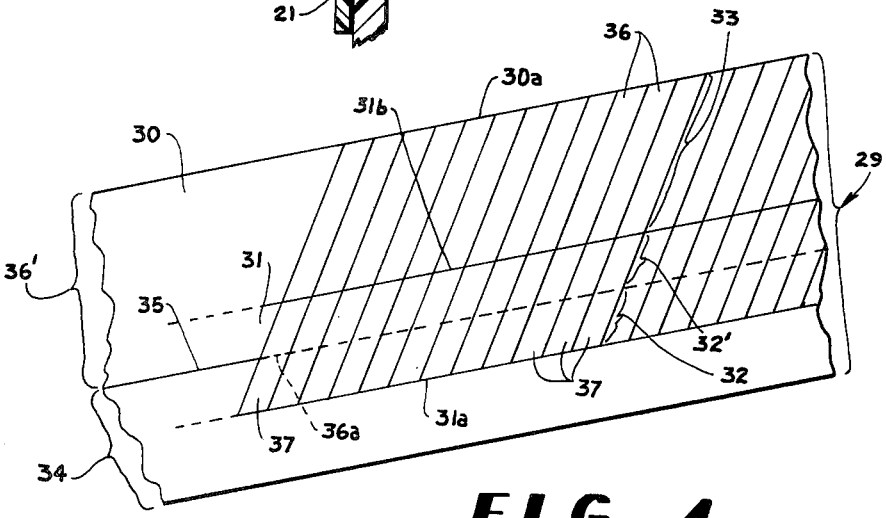
FIG. 4 is a pictorial view showing a portion of the splicing tape assembly according to the present invention.

Looking now at FIGS. 4 and 5 of the drawings, it will be seen that the splicing tape assembly 29 as shown in FIG. 4 is formed by first providing a carrier strip 30 with a length of splicing tape 31 fixed to the carrier strip, the splicing tape 31 being parallel to the edges of the carrier strip 30. The splicing tape 31 may be spaced approximately ⅔ of the distance from a longitudinal edge 30*a* of the carrier strip 30, as best seen in FIG. 4. The splicing tape 31 may be a metallic foil coated with Mylar and having a pressure-sensitive adhesive along the side which confronts the carrier strip 30, while the carrier strip may be made of a suitable material such as paper which is coated with silicone or another material having high adhesive-release properties.

The thickness of the splicing tape 31, but not the thickness of the underlying carrier strip, is next severed at uniform intervals to provide a series of slits 32 which extend diagonally from one longitudinal edge 31*a* of the splicing tape to a point which is between the longitudinal edges 31*a* and 31*b* of the splicing tape. The combined thicknesses of the splicing tape 31 and the underlying carrier strip are both severed to provide the slits 32' which form extensions of the diagonal slits 32 in the splicing tape only. The thickness of the release sheet 30 is severed, from the edge 31*b* of the splicing tape 31 to the edge 30*a* of the release sheet, to provide the slits 33 which form extensions of the diagonal slits 32 and 32'. The carrier strip 30 is next longitudinally slit along its underside 34 to provide the longitudinal slit 35 which extends through the carrier strip, but not through the splicing tape strip 31 which is adhered to the carrier strip.

The carrier strip 30 has thus been severed into two elongate portions, one such portion remaining as a base strip 34 and the other such portion 36' having been slit into a plurality of narrow strips or tabs 36. Each of the tabs 36 has a parallelogram-shape splicing strip 37 attached thereto and overlapping the tab inner end 36*a* and the base strip 34, so that each of the splicing strips 36 is adhesively fixed to the base strip.

It will be seen that the base strip 34 is a continuous piece of the carrier strip 30, and each of the tabs 36 is a piece of the carrier strip 30 that has been slit to provide a narrow length of the carrier strip material in abutting relationship to the base strip 34. Spanning the slit 35 between each tab 36 and the base strip 34, there is one of the splicing strips 37, the splicing strip being adhesively fixed to both the base strip and the tab 36.

Figure 6:
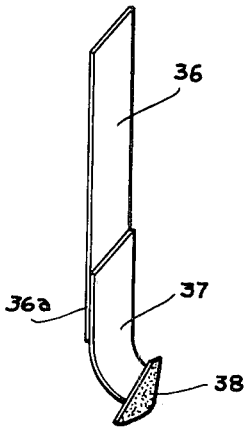

It will now be seen that the base strip 34 with its attached splicing strips 37 and tabs 36 can be rolled onto a spool or the like as is conventional. The spool can then be placed over the core 16 of the dispenser 10, with the tabs 36 extending generally upwardly and tending to fan outwardly of their own weight. The base strip 34 is directed around the guide member 18 of the dispenser 10, and into the clamp member 19. It will be seen in FIG. 3 that the clamp member 19 is so constructed and arranged that the base strip 34 is received between the pressure member 28 and the clamp plate 24 with the splicing strips 37 being above the pressure member 28. Because of this clamping arrangement, it will be readily understood that a person may grasp one of the tabs 36 and pull the tab generally in a leftward direction as viewed in FIG. 3, with the result that the splicing strip 37 will release from the base strip 34 so that the person will be holding a tab 36 with a splicing strip 37 attached thereto and presenting an adhesive portion 38 extending beyond the tab 36. Such a tab and attached splicing strip is seen in FIG. 6. In this condition, the splicing strip 37 can be applied to a piece of magnetic tape as desired and pressed into place; the tab 36 can then be pulled to cause the splicing strip 37 to release from the release coating on the tab, whereupon the remainder of the splicing strip 37 can be completely pressed into place on the magnetic tape.

It will of course be understood that the particular embodiment of the invention here chosen is by way of illustration only, and is meant to be in no way restrictive; therefore, numerous changes and modifications and the full use of equivalents may be resorted to without departing from the spirit or the scope of the invention as defined in the appended claims.

I claim:

1. A dispenser for a splicing tape carrier assembly, said assembly including a continuous base member, a plurality of splicing tape strips extending from one edge of said base member, and a plurality of tabs, each of said tabs extending from one of said strips, said dispenser including a plate, a core extending from said plate for supporting a roll containing a continuous length of said assembly, a clamp assembly supported adjacent to said plate, and guide means carried by said plate for guiding said length of carrier assembly from said core to said clamp assembly, said guide means extending outwardly of said plate such that the edge of said base member opposite said one edge will engage said plate and said one edge extends outwardly of said plate, said clamp assembly having a throat located to receive said base member and including a clamp plate, a clamp jaw selectively movable towards and away from said clamp plate for selectively engaging said base member.

2. A dispenser as claimed in claim 1, said clamp plate and said clamp jaw being connected together by a flexible bend, said bend serving to limit the width of said throat of said clamp assembly to restrict the positioning of said base member.

3. A dispenser as claimed in claim 2, and further including a pressure member carried by said clamp jaw for engaging material in said throat of said clamp assembly, said clamp jaw being so dimensioned that said pressure member will engage said base member in said clamp member below said strips.

4. A dispenser as claimed in claim 3, said clamp plate being so dimensioned as to receive said base member thereagainst substantially without engaging said tabs.

5. A dispenser as claimed in claim 4, said clamp assembly including a release plate fixed to said clamp jaw, said release plate extending away from said throat and being so arranged that pressure on said release plate will cause movement of said clamp jaw away from said clamp plate.

6. A splicing tape carrier assembly comprising a plurality of splicing tape strips having an adhesive side, said strips being disposed contiguously to one another in edge-to-edge relationship, a continuous base member having a release side so constructed and arranged that adhesive will stick temporarily to said release side and will release when pulled away, a first end of each of said strips being on said base member with said adhesive side of said strips engaging said release side of said base member, and a plurality of elongate tabs having one end in abutting relationship with said base member, a second end of each of said strips being releasably adhered to said one end of said one of said tabs, said strip acting to hold one of said tabs in said abutting relationship with said base member, each of said tabs being individually aligned with a corresponding one of said tape strips and being separate from said corresponding tape strip, each of said tabs being contiguous to one another, and each of said tabs having another end which is spaced apart from said corresponding separate tape strip, so that a tape strip can be removed from said base member by pulling the other end of the tab that is held to such tape strip.

7. A splicing tape carrier assembly as claimed in claim 6, each of said tabs having a release side, said adhesive side of said strips engaging said release side of said tabs.

8. A splicing tape carrier assembly as claimed in claim 7, each of said strips having more than half its length on said base member and less than half its length on one of said tabs.

9. A splicing tape carrier assembly as claimed in claim 7, in which said base member and each of said elongate tabs form severed portions of a unitary web of base member material.

* * * * *